US007261525B2

(12) United States Patent
Pekar

(10) Patent No.: US 7,261,525 B2
(45) Date of Patent: Aug. 28, 2007

(54) OUTLET CHECK VALVE FOR FLUID BLADDERS

(75) Inventor: Robert W. Pekar, Florence, MA (US)

(73) Assignee: Dielectrics Industries, Inc., Chicopee, MA (US)

( * ) Notice: Subject to any disclaimer, the term of this patent is extended or adjusted under 35 U.S.C. 154(b) by 0 days.

(21) Appl. No.: 11/215,581

(22) Filed: Aug. 30, 2005

(65) Prior Publication Data

US 2006/0045780 A1 Mar. 2, 2006

Related U.S. Application Data

(60) Provisional application No. 60/606,251, filed on Sep. 1, 2004.

(51) Int. Cl.
*F04B 43/00* (2006.01)
*F04B 39/00* (2006.01)

(52) U.S. Cl. ..... 417/479; 417/480; 417/557; 417/437

(58) Field of Classification Search ..... 417/479, 417/480, 557
See application file for complete search history.

(56) References Cited

U.S. PATENT DOCUMENTS 3,054,418 A * 9/1962 Fromer ..... 137/146
3,133,696 A * 5/1964 Mirando ..... 417/479
4,995,864 A * 2/1991 Bartholomew et al. ..... 604/153
5,074,765 A * 12/1991 Pekar ..... 417/480
5,144,708 A * 9/1992 Pekar ..... 137/223
5,372,487 A 12/1994 Pekar
5,472,325 A * 12/1995 Svendsen ..... 417/437
5,564,143 A 10/1996 Pekar et al.
5,906,597 A * 5/1999 McPhee ..... 604/246
6,120,264 A * 9/2000 Wang ..... 417/480
6,461,125 B1 * 10/2002 Terasawa et al. ..... 417/479

* cited by examiner

*Primary Examiner*—Charles G. Freay
(74) *Attorney, Agent, or Firm*—Cantor Colburn LLP

(57) ABSTRACT

A manually operated pump having a pump assembly and a check valve. The pump assembly includes a dome with a fluid inlet. A support plate is sealed to the dome to define a fluid chamber. The support plate includes a fluid outlet. A foam material is positioned in the fluid chamber, the foam material expanding the dome to a rest state upon release of external pressure on the dome. The check valve has a valve inlet in fluid communication with the fluid outlet of the support plate. The check valve is positioned outside of the fluid chamber. The check valve has at least one exhaust channel to provide one way fluid flow from the fluid chamber through the exhaust channel.

17 Claims, 2 Drawing Sheets

OUTLET CHECK VALVE FOR FLUID BLADDERS

CROSS-REFERENCE TO RELATED APPLICATIONS

This application claims the benefit of U.S. provisional patent application Ser. No. 60/606,251 filed Sep. 1, 2004, the entire contents of which are incorporated herein by reference.

BACKGROUND

This invention relates to valves and more particularly, to such valves as are adapted to control fluid flow out of a chamber to an inflatable bladder.

Digitally operable pumps with thermoplastic check valves are presently known in the relevant art for a variety of applications. One such pump is disclosed in U.S. Pat. No. 5,372,487 (the '487 patent), the entire contents of which are incorporated herein by reference. The pump in the '487 patent is commonly used to inflate elastomeric bladders. While the pump and valve disclosed in the '487 patent are well suited for their intended purpose, the design does require integration of pump and valve in a specific position within a bladder. In the '487 patent, openings and channels are formed in the inflatable bladder to locate the pump at a specific location with respect to the bladder.

SUMMARY

Embodiments of the invention include a manually operated pump having a pump assembly and a check valve. The pump assembly includes a dome with a fluid inlet. A support plate is sealed to the dome to define a fluid chamber. The support plate includes a fluid outlet. A foam material is positioned in the fluid chamber, the foam material expanding the dome to a rest state upon release of external pressure on the dome. The check valve has a valve inlet in fluid communication with the fluid outlet of the support plate. The check valve is positioned outside of the fluid chamber. The check valve has at least one exhaust channel to provide one way fluid flow from the fluid chamber through the exhaust channel.

Other embodiments of the invention include an inflatable bladder having a top sheet and a bottom sheet joined to define the inflatable bladder. A manually operated pump having a pump assembly and a check valve are sealed to an opening in the bladder. The pump assembly includes a dome with a fluid inlet. A support plate is sealed to the dome to define a fluid chamber. The support plate includes a fluid outlet. A foam material is positioned in the fluid chamber, the foam material expanding the dome to a rest state upon release of external pressure on the dome. The check valve has a valve inlet in fluid communication with the fluid outlet of the support plate. The check valve is positioned outside of the fluid chamber. The check valve has at least one exhaust channel to provide one way fluid flow from the fluid chamber through the exhaust channel.

DESCRIPTION

Figure 1:
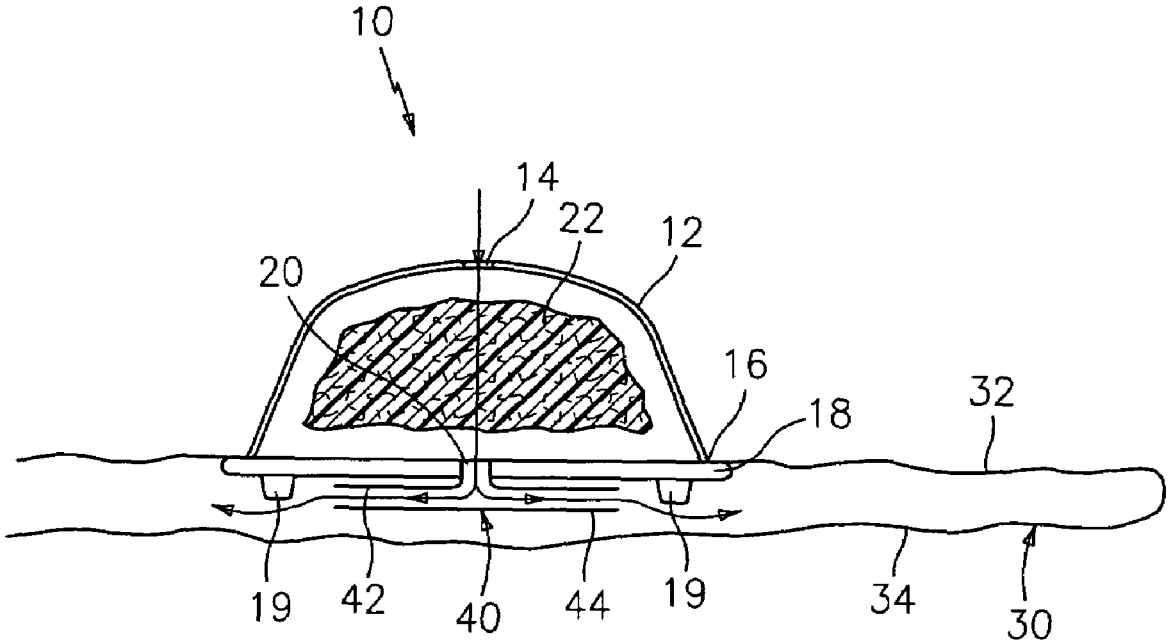
FIG. 1 is a side view of a pump assembly in an embodiment of the invention.

FIG. 1 is a side view of a pump assembly 10 in an embodiment of the invention. Pump assembly 10 includes a resilient dome 12 which may be made from a plastic or rubber material. Dome 12 includes a fluid inlet 14 and a flange 16 at which the dome is joined to a support plate 18. The dome 12 is substantially hemispherical and flange 16 extends radially from an edge of the dome, the flange 16 being sealed to the support plate 18. The support plate 18 is a rigid member and may be made from a plastic or thermoplastic. A fluid outlet 20 is formed in the support plate 18. A foam material 22 is positioned within dome 12 positioned above the support plate 18. Foam material 22 generally fills the full volume of a pump chamber defined by dome 12 as shown in its expanded condition. In an embodiment of the invention, foam material 22 is an open cell elastomeric foam material which allows fluid to flow from the inlet 14 to the outlet 20. The foam material 22 expands the dome to a rest state upon release of external, digital pressure on dome 12.

Flange 16 of dome 12 is secured to the support plate 18 through either bonding with an adhesive or fusing the dome flange 16 to the support plate by applying energy (heat, ultrasonic welding, RF welding, etc.). The seal between the dome 12 and support plate 18 is a fluid-tight seal to define a fluid chamber in which foam material 22 is positioned. If the dome 12 is fused to the support plate, then both dome 12 and support plate 18 are made from thermoplastic materials.

Figure 2:
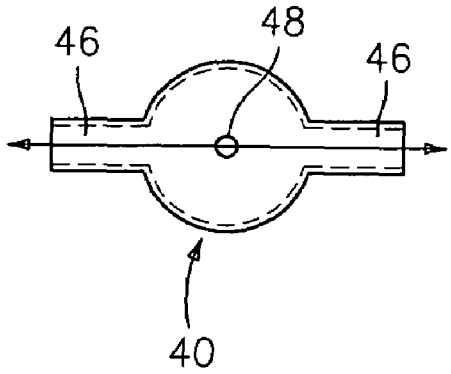
FIG. 2 is a top view of a valve in an embodiment of the invention.

Beneath support plate 18 is a valve 40 having a top valve sheet 42 and a bottom valve sheet 44. As shown in FIG. 2, top valve sheet 42 is secured to bottom valve sheet 44 at the periphery of the sheets to define two exhaust channels 46. It is understood that any number of exhaust channels may be used and embodiments of the invention may have a varying number of channels (e.g., 1, 2, 4) depending on the application. The top valve sheet 42 and a bottom valve sheet 44 may be made from thermoplastic sheet material such as polyurethane or polyvinylchloride. It is understood that other materials may be used such as other plastics, silicones, etc. and embodiments of the invention are not limited to thermoplastics. A valve inlet 48 is formed in top valve sheet 42. Valve 40 is secured to support plate 18 such that valve inlet 48 is in fluid communication with outlet 20. Top valve sheet 42 may be secured to the support plate 18 through either bonding with an adhesive or fusing by applying energy (heat, ultrasonic welding, RF welding, etc.). This may entail bonding a region surrounding valve inlet 48 to a region surrounding outlet 20.

In forming valve 40, release material may be applied between the top valve sheet 42 and bottom valve sheet 44 and the sheets sealed as disclosed in U.S. Pat. No. 5,144,708, the entire contents of which are incorporated herein by reference. As disclosed in the U.S. Pat. No. 5,144,708, release material may be applied to a section between sheets 42 and 44. Limiting the area of the release material promotes adhesion between sheets 42 and 44 facilitating operation as a check valve. Valve 40 serves as a one-way check valve having pliable, superposed thermoplastic layers. The valve layers are attached together along lateral edges (shown by dotted lines) to provide fluid passages from the pump during compression of dome 12 which readily close during the expansion of the pump to prevent the reverse flow of fluid into the pump chamber through the outlet 20. The interior surfaces of top valve sheet 42 and the bottom valve sheet 44 may be high gloss, cohesive surfaces. Thus, when the pump dome 12 is not compressed, the top valve sheet 42 and bottom valve sheet 44 will exhibit substantial cohesion, blocking or surface-to-surface affinity which results in the two sheets having a tendency to stick together. This prevents fluid from exiting bladder 30 through valve 40.

Pump assembly 10 is secured to an inflatable bladder 30 including a top sheet 32 and a bottom sheet 34. The support plate 18 is sealed to top sheet 32 at an opening in the top sheet 32 that overlaps the periphery of the support plate 18. The top sheet 32 may be secured to the support plate 18 through either bonding with an adhesive or fusing by applying energy (heat, ultrasonic welding, RF welding, etc.). The pump assembly 10 is a self-contained assembly allowing the pump assembly 10 to be positioned at any location with respect to bladder 30. This allows the pump assembly 10 to be manufactured independent of the bladder 30. As long as an opening is provided in the bladder, the pump assembly 10 may be easily sealed to the bladder 30. Spacers 19 are formed on the bottom of support plate 18. The spacers 19 distance the bottom bladder sheet 34 away from the valve 40 to prevent the bottom bladder sheet 34 from contacting valve 40 thereby preventing fluid flow.

Figure 3:
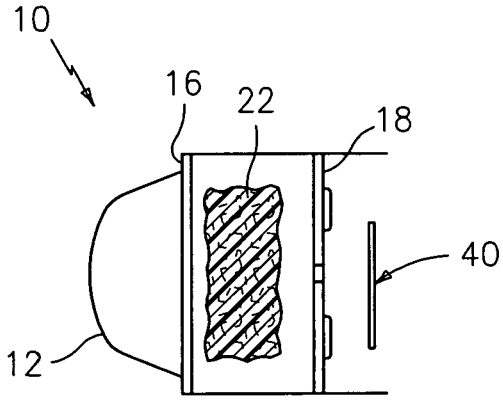
FIG. 3 is an exploded side view of the pump assembly in an embodiment of the invention.
Figure 4:
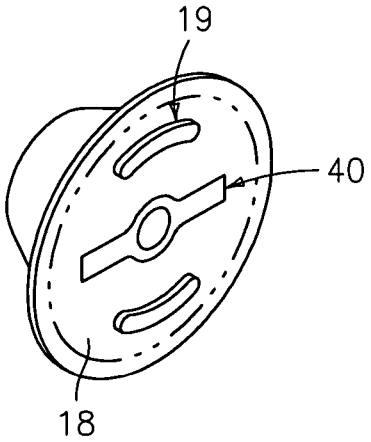
FIG. 4 is perspective view of the bottom of the pump assembly in an embodiment of the invention.

FIG. 3 is an exploded side view of the pump assembly 10 in an embodiment of the invention. FIG. 4 is perspective view of the bottom of the pump assembly in an embodiment of the invention.

In operation, a user places a digit such as a thumb or finger on dome 12 covering inlet 14. Pressing the dome downward towards support plate 18 forces fluid (e.g., air, liquid) through outlet 20 into valve 40 and out through exhaust channels 46. Because of the elastic nature of the open cell foam 22 within the pump chamber and the resilience of the dome 12, when the digital pressure on the dome 12 is released, the dome 12 will return to its original shape and draw ambient fluid through inlet 14. Again, the cohesive nature of the top valve sheet 42 and the bottom valve sheet 44 causes valve 40 to close upon expansion of dome 12, thereby preventing fluid flow from bladder 30 through valve 40.

Figure 5:
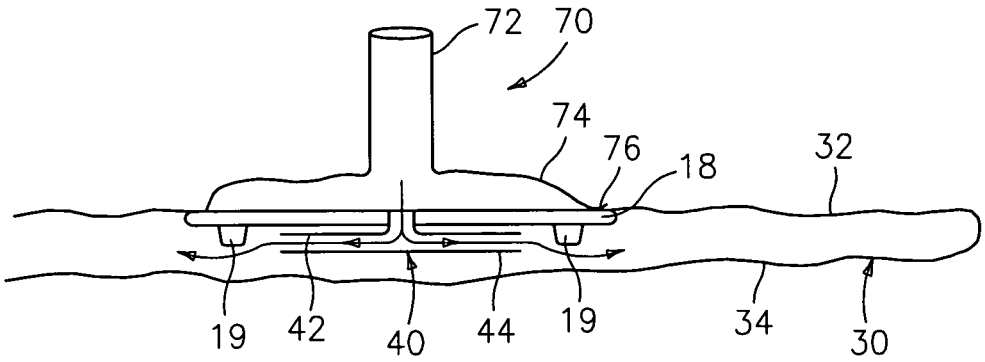
FIG. 5 is a side view of an inlet assembly in an alternate embodiment of the invention.

FIG. 5 is a side view of an inlet assembly in an alternate embodiment of the invention. In this embodiment, the dome 12 and foam 22 are replaced with a hose inlet 70 having a stem 72 and a base 74. The base 74 includes a flange 76 which may be secured to rigid plate 18 in the same manner as flange 16 to define a fluid chamber. The stem 72 may be attached to a source of fluid such as a hose to inflate bladder 30 as described above.

While this invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention.

What is claimed is:

1. A manually operated pump comprising:

a pump assembly including:

a dome with a fluid inlet;

a support plate sealed to the dome to define a fluid chamber, the support plate including a fluid outlet;

a check valve having a valve inlet in fluid communication with the fluid outlet of the support plate, the check valve being positioned outside of the fluid chamber, the check valve having at least one exhaust channel to provide one way fluid flow from the fluid chamber through the exhaust channel;

wherein the check valve includes a top valve sheet having the valve inlet therein and a bottom valve sheet, the top valve sheet and the bottom valve sheet being sealed at a periphery thereof to define the exhaust channel.

2. The manually operated pump of claim 1 wherein:

the dome is substantially hemispherical and includes a flange extending radially from an edge of the dome, the flange being sealed to the support plate.

3. The manually operated pump of claim 1 wherein:

the support plate includes spacers extending from a surface of the support plate opposite the fluid chamber.

4. The manually operated pump of claim 1 wherein:

a foam material is positioned in the fluid chamber, the foam material expanding the dome to a rest state upon release of external pressure on the dome, the foam is an open cell elastomeric foam allowing fluid to flow through the foam.

5. The manually operated pump of claim 1 wherein:

the interior surface of the top valve sheet and the interior surface of the bottom valve sheet are cohesive surfaces.

6. The manually operated pump of claim 1 wherein:

the dome, the support plate and the valve are made from thermoplastic material and joined by applying energy to the thermoplastic material.

7. A manually operated pump comprising:

a pump assembly including:

a dome with a fluid inlet;

a support plate sealed to the dome to define a fluid chamber, the support plate including a fluid outlet;

a check valve having a valve inlet in fluid communication with the fluid outlet of the support plate, the check valve being positioned outside of the fluid chamber, the cheek valve having at least one exhaust channel to provide one way fluid flow from the fluid chamber through the exhaust channel;

wherein the at least one exhaust channel includes two exhaust channels.

8. The manually operated pump of claim 7 wherein:

the at least one exhaust channel includes four exhaust channels.

9. An inflatable bladder comprising:

a top sheet and a bottom sheet joined to define the inflatable bladder;

a pump assembly including:

a dome with a fluid inlet;

a support plate sealed to the dome to define a fluid chamber, the support plate including a fluid outlet; the support plate sealed to the top sheet at an opening in the top sheet;

a cheek valve having a valve inlet in fluid communication with the fluid outlet of the support plate, the check valve being positioned outside of the fluid chamber and within the inflatable chamber, the check valve having an exhaust channel to provide one way fluid flow from the fluid chamber through the exhaust channel to the inflatable bladder;

wherein the valve includes a top valve sheet having the valve inlet therein and a bottom valve sheet, the top valve sheet and the bottom valve sheet being sealed at a periphery thereof to define the exhaust channel.

10. The inflatable bladder of claim 9 wherein:

the dome is substantially hemispherical and includes a flange extending radially from an edge of the dome, the flange being sealed to the support plate.

11. The inflatable bladder of claim 9 wherein:

the support plate includes spacers extending from a surface of the support plate opposite the fluid chamber.

12. The inflatable bladder of claim 9 further comprising:

a foam material is positioned in the fluid chamber, the foam material expanding the dome to a rest state upon release of external pressure on the dome, the foam is an open cell elastomeric foam allowing fluid to flow through the foam.

13. The inflatable bladder of claim 9 wherein:

the interior surface of the top valve sheet and the interior surface of the bottom valve sheet are cohesive surfaces.

14. The inflatable bladder of claim 9 wherein:

the dome, the support plate and the valve are made from thermoplastic material and joined by applying energy to the thermoplastic material.

15. An inflatable bladder comprising:

a top sheet and a bottom sheet joined to define the inflatable bladder;

a pump assembly including:

a dome with a fluid inlet;

a support plate sealed to the dome to define a fluid chamber, the support plate including a fluid outlet; the support plate sealed to the top sheet at an opening in the top sheet;

a check valve having a valve inlet in fluid communication with the fluid outlet of the support plate, the check valve being positioned outside of the fluid chamber and within the inflatable chamber, the check valve having an exhaust channel to provide one way fluid flow from the fluid chamber through the exhaust channel to the inflatable bladder;

wherein the at least one exhaust channel includes two exhaust chambers.

16. The inflatable bladder of claim 15 wherein:

the at least one exhaust channel includes four exhaust channels.

17. A fluid device comprising:

a hose inlet having a stem and a base;

a support plate sealed to the base to define a fluid chamber, the support plate including a fluid outlet;

a check valve having a valve inlet beneath the support plate in fluid communication with the fluid outlet of the support plate, the check valve being positioned outside of the fluid chamber, the check valve having at least one exhaust channel to provide one way fluid flow from the fluid chamber through the exhaust channel;

wherein the check valve includes a top valve sheet having the valve inlet therein and a bottom valve sheet, the top valve sheet and the bottom valve sheet being sealed at a periphery thereof to define the exhaust channel.

* * * * *